US009095782B2

(12) United States Patent
Kaplan

(10) Patent No.: US 9,095,782 B2
(45) Date of Patent: Aug. 4, 2015

(54) PORTABLE APPARATUS AND METHOD FOR PRODUCING A SIMULATED FLAME EFFECT

(71) Applicant: A & T Creative Workshop Inc., Marietta, GA (US)

(72) Inventor: Levi Kaplan, Marietta, GA (US)

( * ) Notice: Subject to any disclaimer, the term of this patent is extended or adjusted under 35 U.S.C. 154(b) by 131 days.

(21) Appl. No.: 14/105,855

(22) Filed: Dec. 13, 2013

(65) Prior Publication Data

US 2014/0168946 A1 Jun. 19, 2014

Related U.S. Application Data

(60) Provisional application No. 61/737,170, filed on Dec. 14, 2012.

(51) Int. Cl.

| | |
|---|---|
| ***A63J 5/02*** | (2006.01) |
| ***F21S 10/04*** | (2006.01) |
| ***F21V 21/30*** | (2006.01) |
| *F24C 7/00* | (2006.01) |
| *F21Y 101/02* | (2006.01) |

(52) U.S. Cl.

CPC *A63J 5/023* (2013.01); *A63J 5/025* (2013.01); *F21S 10/04* (2013.01); *F21V 21/30* (2013.01); *F21Y 2101/02* (2013.01); *F24C 7/004* (2013.01)

(58) Field of Classification Search

CPC ..... A63J 5/023–5/025; F25C 7/004

See application file for complete search history.

(56) References Cited

U.S. PATENT DOCUMENTS 9,052,079 B2 * 6/2015 O'Neill ..... 1/1

* cited by examiner

*Primary Examiner* — Mary Ellen Bowman

(74) *Attorney, Agent, or Firm* — Francis J. Maguire; Ware Freesola Maguire & Barber LLP

(57) ABSTRACT

A special effect device for producing a simulated flame effect includes a plurality of discharge nozzles, a source of compressed air, a source of pressurized water, and a control device for supplying the compressed air and the compressed water to the discharge nozzles for proportioning the compressed air and water such that each discharge nozzles creates a plume of water vapor, consisting of micron sized water droplets. A plurality of light sources configured to deliver a mixture of colored lighting, is disposed in proximity to the plume and directed thereto, such that the light mixing and reflecting from the plume creates a simulated flame effect.

11 Claims, 4 Drawing Sheets

PORTABLE APPARATUS AND METHOD FOR PRODUCING A SIMULATED FLAME EFFECT

CROSS REFERENCE TO RELATED APPLICATIONS

This application claims priority in U.S. Provisional patent Application No. 61/737,170, filed 14 Dec. 2012, the contents of which are hereby incorporated by reference.

TECHNICAL FIELD

The present invention is directed to a portable apparatus and method for producing a simulated flame effect.

BACKGROUND

In the performance of musical and other theatric productions, it is often desirable to provide various special effects, including for example, flame effects. Given the safety hazards associated with producing actual flames in crowded environments, various efforts have been made to provide a realistic flame effect without the inherent danger associated with actual flames.

For example, in U.S. Pat. No. 5,989,128, an apparatus is described which uses water and air sprayed into a display area to form a wall of mist which reflects light, with the air blown by fans to create a curtain of turbulence, with the upwardly flowing air holding up the wall of mist and making light projected onto the mist appear to flicker to simulate flames. However, the apparatus is quite large, bulky, complex and costly to produce, and the simulated flames are of relatively low quality.

In U.S. Pat. Nos. 6,685,574 and 6,802,782, other apparatus for producing simulated smoke and flames is described which utilize steam, and again, utilize large, bulky and complex apparatus, with the additional requirement to utilize heat to produce steam.

In U.S. Pat. No. 7,762,897, yet another flame simulating apparatus is described which utilizes a steam manifold to produce a curtain of steam with a substantially uniform steam density, and as with the other prior art devices, relies of an elongated curtain generated by an elongated body with output ports distributed along the length of the elongated body so that a curtain of steam is produced adjacent to the outlet slot for substantially the length of the console. The requirement for a steam generator, as well as the other components requires that the installation and use of the apparatus be relatively permanent, and so while useful in fixed applications, the apparatus has limited usefulness with for example, a short play or musical production.

While various devices and methods are known for producing simulated flame effects, these suffer from complexity, cost, and lack substantial portability, and what is needed in the art is a portable flame simulating device and method, and one which produces improved three dimensional flame simulation as compared to the relatively two dimensional flame images utilized in the prior art.

SUMMARY OF THE INVENTION

It is an object of the present invention to provide a compact flame simulating apparatus which is more easily transportable that the prior art devices.

It is yet another object of the present invention to provide a compact flame simulating apparatus and method that avoids the use of steam, and the complexities associated therewith, yet which provides superior flame simulating effects.

It is yet another object of the present invention to provide a compact, portable flame simulating apparatus and method which provides an improved and substantially realistic flame effect from multiple viewing angles, and also to provide a flame effect of varying heights.

These and other objects of the present invention are achieved by a special effect device for producing a simulated flame effect comprising a plurality of discharge nozzles mounted to a manifold, a source of compressed air, a source of pressurized water, a control device for supplying the compressed air and the compressed water to the discharge nozzles for proportioning the compressed air and water such that each discharge nozzles creates a plume of water vapor, consisting of micron sized water droplets, a plurality of light sources adapted for delivering a mixture of colored lighting, disposed in proximity to the plume and directed thereto, such that the light mixing and reflecting from the plume creates a simulated flame effect.

In one embodiment, a plurality of different colored glass filters are interchangeably fitted adjacent the light sources to create the different colored light, the light sources being adjustable for adjusting the intensity and distribution of light directed to the plume.

In another embodiment, the special effects device is assembled with the components as a modular unit, having from four to ten discharge nozzles, and including connecting devices such that multiple modular unit special effects devices can be connected together for creating larger effects, thus the device can provide a wide range of flexibility in the production of simulated flame effects, depending on the arrangement of the device modules.

In another embodiment, a transportable power unit which includes an air pump, air tank, water pump and water tank is provided, so as to be able to quickly set up for a simulated flame effect, ready for generation, and then to break down and transport the unit and the device modules to another venue.

In yet another embodiment, one or more flow control devices is associated with one or more of the discharge nozzles so as to vary the discharge from individual nozzles, to thereby permit a user to customize and vary the displayed simulated flames, as needed to optimize the effects for viewers, for example to make the flames rise or fall in timed relation to other events occurring. Of course, the height of the simulated flames can vary from small to quite tall, depending on the nozzle selection, pressures, and light locations. A computer or microprocessor based flame control unit may be used to control both the discharge from the nozzles as well as the light intensity and color mix, by controlling the air pressure, water pressure, water flow, mix of air to water to be discharged, light dimming devices, color wheel and/or color filter selection, etc., such that directing the appropriately colored light onto the small micro particles of the plume causes an interaction of the light with the plume to yield a highly realistic simulated flame effect.

The lighting sources used are preferably light emitting diodes (LED), because of their low energy consumption and ease of controllability. The number used can vary widely, but from 8 to 20, more preferably 10 to 18, most preferably 12-16, LED lights are provided per each modular unit having for example four discharge nozzles.

In use, it is preferred that a shield be disposed around the unit so as to prevent viewing of the flame generating apparatus. This shield would completely surround the special effects devices. and may include decorative elements as appropriate for simulating a base supporting actual flames. The shield may vary in height, depending on the height of the plume to be generated, which can rise upwards for from about 2 to 8 feet.

In one particular embodiment, compressed air and water, pressurized to between 20-30 psi are supplied to each of the four discharge nozzles which eject the mixture as a vapor having water droplet particles of from 7-10 micron in size, the plume generated rising from about 2-8 feet. In one embodiment, two rows of LED's which act as the light sources are positioned adjacent the nozzles on each side thereof, angled so as to illuminate a longitudinal plume to simulate a flame curtain, generally the LED's angled at from 30-40 degrees. Light from each LED is passed through a selectable color filter, generally these being red, yellow, amber, which are typical flame colors, though green, blue, violet, etc., may also be used, so as to generate a particular color mix so as to provide a desired simulated flame effect which closely mimics the dynamic action of an actual flame. Of course, the choice of colors is left to the user. The light sources are controlled by a control unit, as are the water and air supply devices, with all of these being coordinated by the control unit to provide the proper interaction between the light and the plume.

In another embodiment of the invention, a plurality of modular special effects units are disposed in an array and interconnected, with a master control unit connected thereto for operating the plurality of modular units to create relatively large and diverse controlled displays of the simulated flames, possibly coordinated with music, video, or a theatrical performance. This could also be associated with a single or multiple transportable power units for supplying the utilities, air, water and power, to the modular special effects units. In this way, a relatively low cost, safe, yet highly effective flame simulation can be delivered in virtually any area, large or small, yet still remain portable.

BRIEF DESCRIPTION OF THE DRAWINGS

The following attached figures illustrate the various embodiments of the invention, in which.

DETAILED DESCRIPTION OF THE INVENTION

Figure 1:
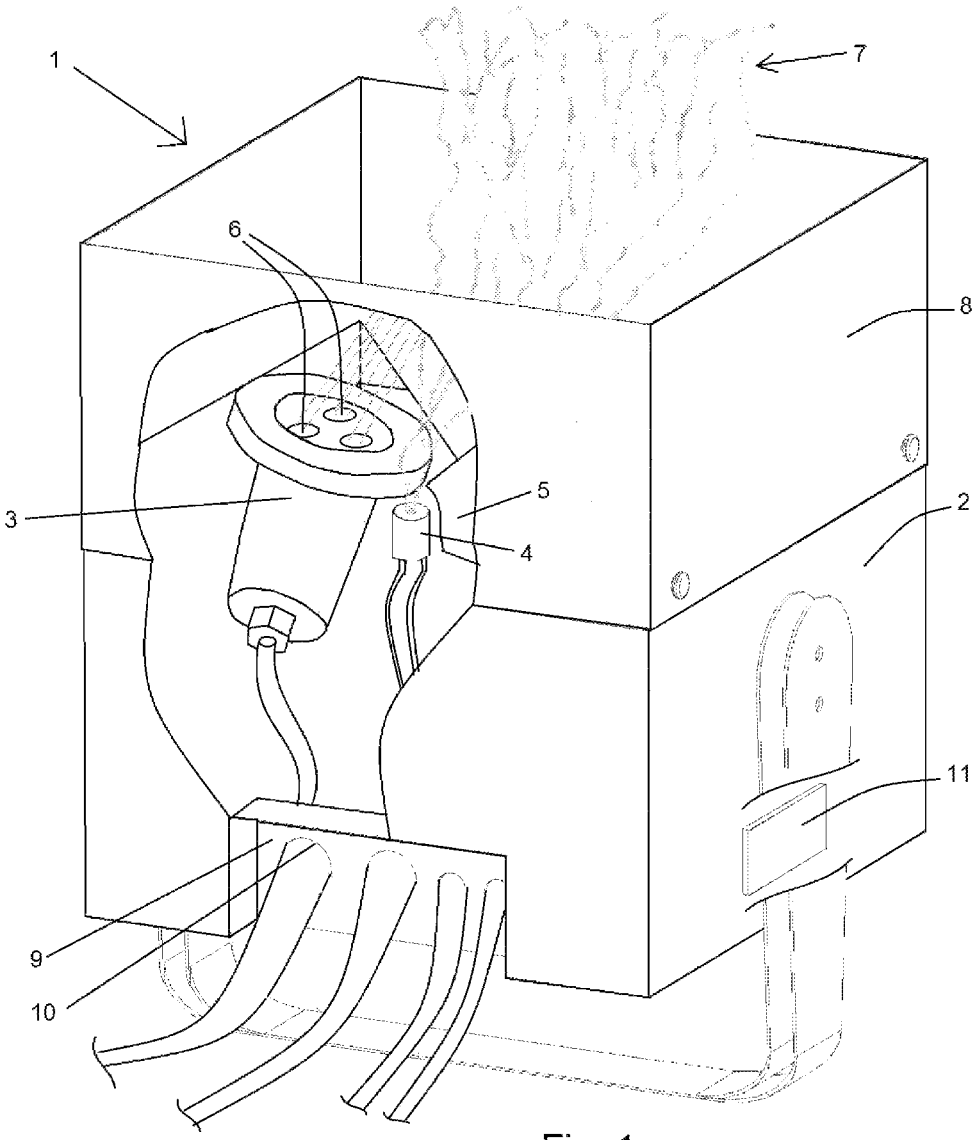
FIG. 1 is a perspective view of the special effects device of the invention, with a cut away portion for ease of illustration.

Referring to FIG. 1, a special effects device 1 has a housing 2 for containing a plurality of lighting fixtures 3 and another plurality of nozzles 4 arranged in a square array. In this embodiment, four nozzles 4 are centrally located on a top surface 5 of the housing. Each lighting fixture 3 houses one or more lighting sources 6, with the housings angularly disposed so as to illuminate a central plume of spray 7 generated by the nozzles 4. The housing includes a shroud 8 disposed so as to shield the lighting fixtures an nozzles, so as to provide a simulated flame effect above the shroud. A connection panel 9 has fittings 10 for removably connecting the nozzles 4 to a source for air and water, and the lighting sources 6 to a power source. In some cases, a control unit having a display 11, will be integral with each module, and appropriate valves and control units will be included within the housing, so that operation may be controlled locally. Typically, a wireless or wired connection will be provided for linking the device 1 to a master control unit, for coordinated control with other special effects devices.

Figure 2:
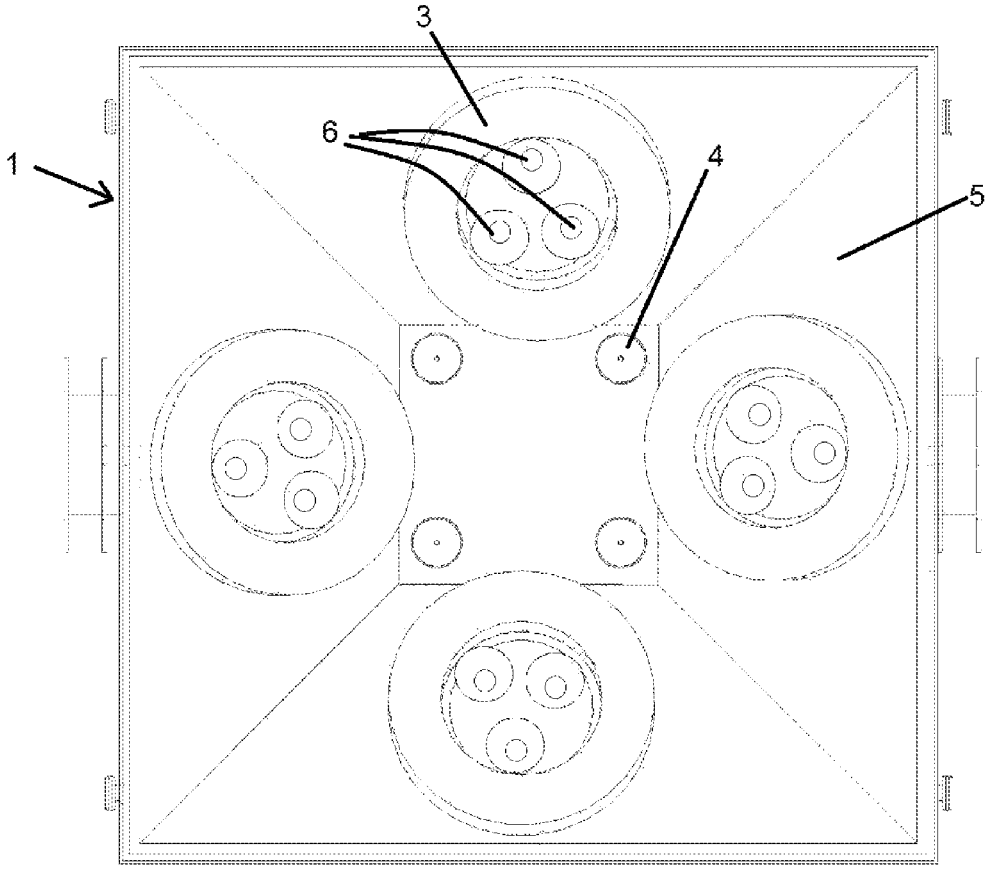
FIG. 2 is a top view thereof.

Referring to FIG. 2, a top view of the top surface 5 of the housing 2 is shown. Each lighting fixture 3 in this embodiment contains three lighting sources 6, preferably LED's that can be associated with various color lenses or other color generation means, so as to generate various color combinations of light that would engage the plume generated by the four centrally located nozzles 4. As the plume of vapor provides a reflective surface, the movement of the plume and the variations in the lighting being controlled so as to produce a realistic flame effect, without the use of steam, eliminating any safety issues associated with heat or heat generating devices.

Figure 3:
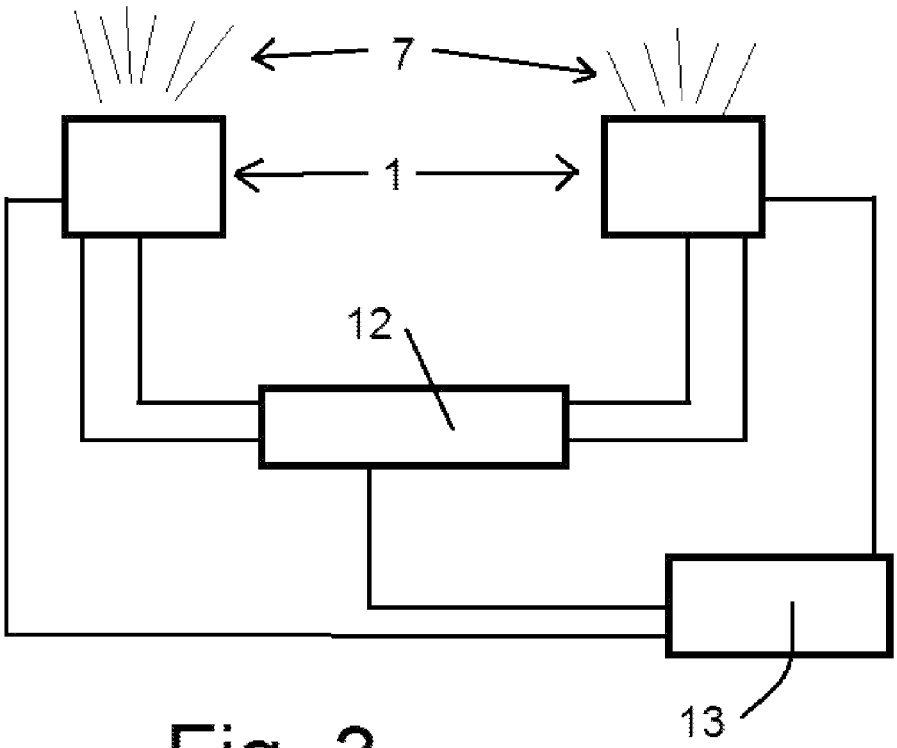
FIG. 3 is a schematic view showing multiple special effects devices interconnected for generating a larger scale simulated flame effect; and, FIGS. 4*a* and 4*b* show an alternative embodiment of the invention, using a linear arrangement which folds up for ease in transportation.

Referring to FIG. 3, a schematic view shows a transportable power unit 12 which is located remotely from the plurality of special effects devices 1, to act as a common remote source of compressed air, as well as a remote source of pressurized water, with these supplied to the nozzles for generating the plumes 7. A master control device 13 controls the supply of the compressed air and the compressed water to the discharge nozzles for proportioning the compressed air and water such that each discharge nozzles creates a plume of water vapor, consisting of micron sized water droplets, either directly, or through control of local control units fitted with each device 1. The master control device 13 also acts as the lighting controller, which controls the lighting sources in the lighting fixtures. This may be, for example, a DMX lighting controller, typically used for control of LED lights, with the master control unit coordinating the plumes generated from each device 1, so as to produce the appropriate user required special effect.

"DMX" is an abbreviation for DMX512-A, the Entertainment Services Technology Association (ESTA) Standard for controlling lighting equipment and related accessories. A wide variety of lighting control consoles, controllers and other devices that output DMX signals can be used to connect to an even greater variety of lighting fixtures and accessories that can be controlled by DMX. DMX controlled lighting systems are used in many professional settings, including concert lighting, stage lighting, studio lighting, theme park attractions, etc., as would be understood by those skilled in these types of lighting systems, and so would be well suited to use with the present invention.

As illustrated, the special effects device 1 is usable as a modular unit, that is, it may be assembled with, and interconnected to one or more additional special effects devices, such that multiple modular unit special effects devices can be placed in a particular arrangement and used to create larger effects, or spatially separated but coordinated multiple special effects, providing a wide range of flexibility in the production of simulated flame effects, depending on the number and arrangement of the device modules.

Typically, the portable special effects devices are connected to one or more transportable service units, each unit supplying the specific utilities needed to produce the effects, including an air pump for the compressed air source, an air tank to hold the compressed air, a water pump and a water tank are provided for supplying the water for generating the plume. Being remotely located assures that any noise can be isolated, and also frees up space in the area surrounding the location where the special effect will be generated. This also allows the devices themselves to be relatively small in size, so as to minimize floor space requirements. As no actual flame is generated, nor steam used, the devices are non-hazardous, and so can be placed in virtually any location. Generally, the master control device is portable and located at an intermediate location, possibly where other lighting and sound is controlled so that the effects can be generated in combination with other lighting or sound effects.

While one master control device is described, it will be understood that one or more control devices can be associated with the one or more discharge nozzles so as to vary the discharge for individual nozzles, to thereby permit a user to customize and vary the displayed simulated flames, as needed to optimize the effects for viewers, for example, to make some flames rise or fall in timed relation to other events occurring. Of course, the height of the simulated flames can vary from small to quite tall, depending on the nozzle selection, pressures, and light locations. The control unit can control both the discharge from the nozzles as well as the light intensity and color mix, by controlling the air pressure, water pressure, water flow, mix of air to water to be discharged, light dimmer devices, etc., such that directing the appropriately colored light onto the small particles of the plume causes an interaction of the light with the plume to yield a highly realistic simulated flame effect.

Figure 4A:
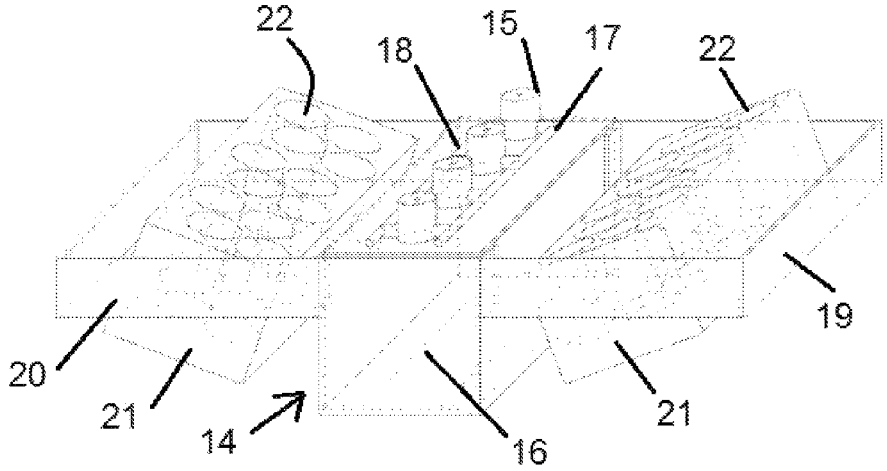
Figure 4B:
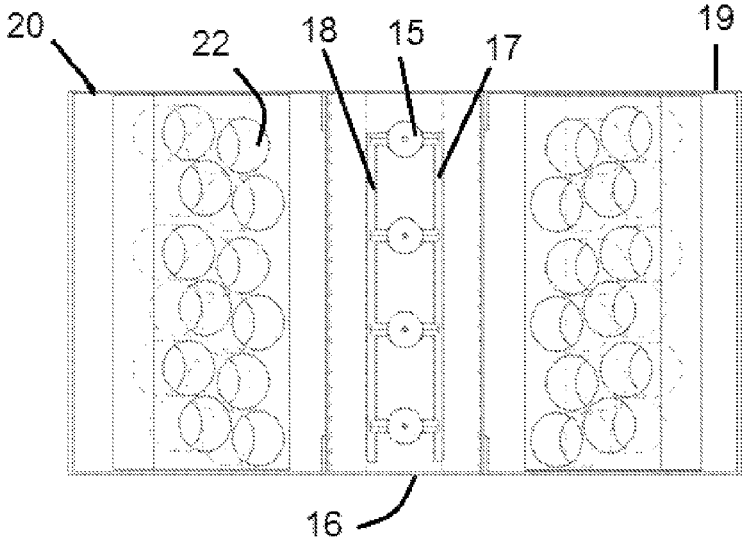

Referring to FIGS. 4*a* and 4*b*, an alternative embodiment of the invention is shown. In this embodiment, a device 14 has a linear array of nozzles 15, as opposed to the square array of the previous embodiment. In this embodiment, a central housing 16 includes four nozzles 15 connected to a pair of manifolds 17 and 18 which supply the air and water for generating the plume. The central housing 16 has a foldable pair of wings 19 and 20, each wing supporting a tiltable lighting box 21 supporting a plurality of light sources 22. This embodiment is easily transportable, and can be set up rather quickly by folding out the wings, aligning the lighting boxes, using quick connectors for connecting to a remote transportable power unit and to a master control. Being in a linear array allows daisy chaining multiple devices together to generate for example an extended flame curtain, or to place units side by side to provide a depth to the simulated flames. The nozzles are preferably fitted with quick disconnects, so as to rapidly connect for plume generation. The LED banks in the lighting boxes can swivel, either manually or via automatic control, to focus the light on the plume. Internal or external electronics can contain electronic air and water regulators to control flow delivered to each nozzle individually.

In one embodiment of the invention, the transportable supply unit contains a water pump, an air pump, a water reservoir, and an LED Driver. This unit is capable of delivering air at a pressure suitable for producing micron sized droplets, which may be on the order of about 30 psi. The water pump is capable of delivering water in a quantity suitable for producing the micron sized water particles, which can vary, but in this example, would be at or around 12 gal/hour for supplying multiple special effects devices and their associated nozzles, the flows to the actual nozzles being regulated within each special effects device, for example, down to about 1.1 liters/hour. As to the nozzles themselves, within the given parameters, the range in opening size can vary from about 0.6 to 6 mm, and individual nozzles within a particular array can be varied to produce particular effects. As would be understood by those skilled in the art, the selection of a particular nozzle depends on the provided operating parameters for the air and water, and so many different nozzle sizes can work with the present invention, with the proviso that the selected nozzles do provide the very fine micron sized particles for optimum performance in simulating flame effects.

In one embodiment, the transportable supply unit supplies the needed utilities to four special effects units, to maintain the modularity of the overall system, though of course, other larger or smaller transportable supply units could easily be made, to service for example, from 2 to 12 or more special effects devices. Typically, flexible air and water hose are used to deliver the air and water from the supply unit to a first special effects device, and then run from device to device, in a chain.

In one embodiment of the invention, each special effects device contains a 24v power supply, a fan, an LED processor, a water manifold connected to four nozzles, an air manifold also connected to the four nozzles, and five control valves, which may use the 24v power for operation. One valve would be configured to control the water supply to one nozzle, so that each nozzle is separately controllable, while the fifth control valve would be configured to controls the air feed to all the nozzles. One or more optional flow restrictors could be used to limit the flow of water to the nozzles, for example, to 1.1 liters/hour. As discussed above, in one embodiment, the four nozzles are arranged in a square pattern in the center of the unit. Four color LEDs, preferably Red, Blue, Green and Amber, surround each nozzle, preferable the LEDs are 3 w/color/led., for a total of 12 w Red, 12 w Blue, etc. The LED sources may be provided as LED chips with lenses attached, preferably contained in a water-resistant housing. The control electronics provided within the device in this embodiment would preferably operate on a 24v DC system, for compatibility with the DMX 512 protocol, and are also preferably sealed to prevent water infiltration.

Connectors are provided with each special effects device for supplying the water to and through the water manifold, with connectors provided to pass on the water supply to another special effects device, so that the full flow of water is passed to the device in the chain, while the immediate device has the water flow to the nozzles controlled by the associated valves, with or without the flow restrictors. Connectors are similarly provided for delivery and pass through of the air supply to the devices in the chain. Of course, electrical and control connectors are also provided in each special effects unit, to direct the operation of the devices in generating the simulated flame effects, as described previously.

It should be understood that the invention is adaptable for use in relatively small versions. For example, a small fully integrated flame simulating unit can be provided having one or more small or miniature nozzles, with a somewhat miniaturized delivery system for supplying air and water thereto, for example, the unit being small enough to simulate a candle flame, a lantern or a torch. With the current ability to make microelectronic devices, responsive to control signals, both wired and wireless, there are many opportunities to use the invention in many applications. One example would be as a novel home humidifier, where the plume for providing the flame simulation is not just decorative, but functional as it delivers moisture into the air, and the invention may be well suited to providing a unique decorative element to such a room humidifier. Thus, while theatrical applications are discussed above, the fact that the device uses no heat, and no steam, and so is essentially harmless, opens the door to many applications of the invention in commercial and home products, including in games, toys, in amusement venues as well as in theater settings.

While preferred embodiments of the invention have been shown and described for illustrative purposes, it will be understood by those skilled in the art that these embodiments are in no way limiting on the scope of the invention, and that various changes and modifications can be made without varying from the spirit and scope of the invention.

The invention claimed is:

1. A special effect device for producing a simulated flame effect comprising:

one or more discharge nozzles, each having an opening sized for generating micron sized fluid droplets;

a source of compressed air, a source of pressurized water, and a control device for regulating a supply of compressed air and pressurized water to the discharge nozzles for proportioning the compressed air and water such that each discharge nozzles creates a plume of water vapor, consisting of micron sized water droplets, one or more light sources disposed in proximity to the plume and aligned for directing light thereto, such that the light mixes and reflects from the plume to simulate a flame effect.

2. The device of claim 1 further comprising one or more flow control devices associated with the one or more of the discharge nozzles so as to vary the discharge from individual nozzles, to permit customizing and varying the displayed simulated flames.

3. The device of claim 1 wherein the special effects device is a transportable modular unit, having from four to ten discharge nozzles, and including connectors for assembling multiple transportable modular units together for creating larger effects.

4. The device of claim 3 further comprising a transportable power unit which includes the source of compressed air and the source of pressurized water, and connectors so as to be able to quickly connect one or more of the transportable modular units together to generate a combined simulated flame effect, and then to break down and transport the power unit and transportable modular units to another venue.

5. The device of claim 1 wherein the lighting sources are one or more light emitting diodes.

6. The device of claim 1 further comprising a control unit disposed in the housing, air and water regulating devices disposed in the housing and being responsive to the control unit for controlling the supply of fluid and air delivered to each nozzle and for controlling the one or more lighting sources.

7. The device of claim 1 further comprising a master control unit for controlling a plurality of special effects devices, and a wireless or wired connection provided for linking each special effects device to the master control unit, for coordinated control of the plurality of special effects devices.

8. The device of claim 4 further comprising a master control unit for controlling a plurality of special effects devices, and one or more transportable power units, and a wireless or wired connection provided for linking each special effects device and transportable power unit to the master control unit, for coordinated control of the plurality of special effects devices.

9. The device of claim 6 further comprising a master control unit for controlling a plurality of special effects devices, and a wireless or wired connection provided for linking the control unit of each special effects device to the master control unit, for coordinated control of the plurality of special effects devices.

10. A system for producing special effects comprising:

a plurality of transportable special effect devices, each device having a housing containing a plurality of discharge nozzles, each having an opening sized for generating micron sized fluid droplets, and a plurality of light sources disposed in proximity to the plume and aligned for directing light thereto, such that the light mixes and reflects from the plume to simulate a flame effect, each special effects device having connectors for connecting to a remote source of air, water and power;

one or more transportable power units having a source of compressed air and a source of pressurized water, and power for the lighting sources, and having connectors so as to be able to quickly connect the plurality of special effects devices thereto; and, a master control device for controlling the supply of the compressed air and the pressurized water to the discharge nozzles for proportioning the compressed air and water such that each discharge nozzles creates a plume of water vapor, consisting of micron sized water droplets, either directly, or through control of local control units fitted with each special effects device, the master control device controlling the lighting sources in the plurality of special effects devices to generate a combined simulated flame effect.

11. A method for producing a simulated flame effect without using steam, heat or combustible materials comprising:

providing one or more discharge nozzles, each having an opening sized for generating micron sized fluid droplets;

providing a source of compressed air, a source of pressurized water, and a control device for regulating a supply of compressed air and pressurized water to the discharge nozzles for proportioning the compressed air and water such that each discharge nozzles creates a plume of water vapor, consisting of micron sized water droplets, providing one or more light sources disposed in proximity to the plume and aligned for directing light thereto, such that the light mixes and reflects from the plume to simulate a flame effect generating the micron sized water droplets to form the plume, and, controllably using the lighting sources for illuminating the plume.

* * * * *